US009611845B2

(12) United States Patent
Schiavone et al.

(10) Patent No.: US 9,611,845 B2
(45) Date of Patent: Apr. 4, 2017

(54) EQUIPMENT FOR CONTINUOUS REGULATION OF THE FLOW RATE OF RECIPROCATING COMPRESSORS

(75) Inventors: Massimo Schiavone, Carrara (IT); Andrea Raggi, Lerici (IT)

(73) Assignee: DOTT.ING. MARIO COZZANI S.R.L., Arcola (IT)

( * ) Notice: Subject to any disclaimer, the term of this patent is extended or adjusted under 35 U.S.C. 154(b) by 1098 days.

(21) Appl. No.: 12/306,323

(22) PCT Filed: Jun. 22, 2007

(86) PCT No.: PCT/EP2007/056244
§ 371 (c)(1),
(2), (4) Date: Dec. 23, 2008

(87) PCT Pub. No.: WO2008/000698
PCT Pub. Date: Jan. 3, 2008

(65) Prior Publication Data

US 2009/0238700 A1 Sep. 24, 2009

(30) Foreign Application Priority Data

Jun. 28, 2006 (IT) ..... GE2006A0067

(51) Int. Cl.
*F04B 49/00* (2006.01)
*F04B 49/24* (2006.01)
(Continued)

(52) U.S. Cl.
CPC ..... *F04B 49/243* (2013.01); *F04B 49/03* (2013.01); *F04B 49/06* (2013.01);
(Continued)

(58) Field of Classification Search
CPC ..... F04B 53/1012; F04B 49/02; F04B 49/06; F04B 49/065; F04B 49/03; F04B 49/225;
(Continued)

(56) References Cited

U.S. PATENT DOCUMENTS 2,626,100 A * 1/1953 McIntyre ..... 417/44.7
2,991,924 A * 7/1961 Ramsay ..... 417/446
(Continued)

FOREIGN PATENT DOCUMENTS

EP 1 338 794 8/2003

*Primary Examiner* — William H Rodriguez
*Assistant Examiner* — Stephen Mick
(74) *Attorney, Agent, or Firm* — Marvin Petry; Stites & Harbison PLLC

(57) ABSTRACT

Equipment for continuous regulation of the flow rate of fluid in a reciprocating compressor which has a compression chamber with a piston reciprocally movable therein. The compression chamber has an inlet valve and an outlet valve which delivers fluid to a reservoir. A translation device is movable to open the valve and allow closing of the valve. An actuator engages the translation device and includes a rod. The rod has a magnitizable central element located between solenoids of an electromechanical device. The central element is located in a prefixed position with respect to the solenoids under the resilient loading of a resilient device. Detectors are provided for detecting the position of the piston, the pressure in the reservoir and the position of the actuator.

6 Claims, 5 Drawing Sheets

(51) Int. Cl.
*F04B 49/03* (2006.01)
*F04B 49/06* (2006.01)

(52) U.S. Cl.
CPC ..... *F04B 2201/0601* (2013.01); *F04B 2201/0604* (2013.01); *F04B 2205/08* (2013.01)

(58) Field of Classification Search
CPC ..... F04B 49/243; F04B 2201/06011; F04B 2201/0602; F04B 2201/06061; F04B 2205/09; F04B 2205/171; F04B 2205/063; F04B 41/02; F04B 7/0057; F04B 7/0069; F04B 7/0076; F04B 39/08; F04B 39/10; F04B 49/22; F04B 49/24; F04B 2201/0601; F04B 2201/0604; F04B 2201/0606; F04B 2205/17; F16K 1/42; F16K 25/00; F16K 31/0679
USPC ..... 417/23, 26, 53, 274, 298, 295; 251/129.09, 129.1, 33–334, 359
See application file for complete search history.

(56) References Cited

U.S. PATENT DOCUMENTS 3,119,940 A * 1/1964 Pettit et al. ..... 310/24
3,653,783 A * 4/1972 Sauder ..... F04B 49/022 417/298
4,369,633 A * 1/1983 Snyder ..... F25B 1/10 417/254
4,892,465 A * 1/1990 Born et al. ..... 417/218
5,106,288 A * 4/1992 Hughes ..... 425/174.4
5,388,968 A * 2/1995 Wood et al. ..... 417/295
5,540,558 A * 7/1996 Harden et al. ..... 417/53
5,622,478 A 4/1997 Elliott et al.
5,630,709 A * 5/1997 Bar-Cohen ..... 417/322
5,687,765 A * 11/1997 You ..... 137/627.5
5,833,209 A 11/1998 Steinruck
5,988,985 A * 11/1999 Steinruck ..... 417/53
6,577,089 B1 * 6/2003 Piedl et al. ..... 318/432
6,641,371 B2 * 11/2003 Graziani et al. ..... 417/274
6,830,233 B2 * 12/2004 Katsumata ..... F01L 9/04 123/90.52
2003/0156952 A1 * 8/2003 Couillard ..... F04B 11/0075 417/297
2003/0160197 A1 * 8/2003 Kodama ..... 251/57
2004/0091365 A1 5/2004 Spiegl et al.
2004/0149944 A1 * 8/2004 Hopper et al. ..... 251/54
2004/0213679 A1 * 10/2004 Cornwell ..... 417/307
2004/0265134 A1 * 12/2004 Iimura et al. ..... 417/38
2005/0046531 A1 * 3/2005 Moyer ..... F01L 9/04 335/256
2007/0139211 A1 * 6/2007 Pessin ..... E21B 47/0008 340/679
2007/0272890 A1 * 11/2007 Kopecek ..... F04B 7/0076 251/129.1
2007/0295926 A1 * 12/2007 Kopecek et al. ..... 251/129.16

* cited by examiner

EQUIPMENT FOR CONTINUOUS REGULATION OF THE FLOW RATE OF RECIPROCATING COMPRESSORS

BACKGROUND OF THE INVENTION

The present invention relates to reciprocating compressors, and in particular to equipment for continuous regulation of the flow rate in the said compressors.

There are various possible methods of regulating the flow rate: devices external to the compressor which may be considered are on/off operation, variation of the speed of the motor driving the compressor, a by-pass between the delivery and inlet, and inlet throttling, while devices forming part of the compressor itself which may be considered are idle/load operation, backflow control and the introduction of an additional dead space which may be constant or variable.

Regulation by means of additional dead space is provided by adding a dead space to the cylinder to enable the opening of the pressure valves to be delayed, thus reducing the flow rate; it is possible to carry out either step regulation, by adding various dead spaces of different capacities, or continuous (stepless) regulation, by using an additional dead space of variable capacity, as indicated in U.S. Pat. No. 6,641,371.

Idle/load operation, which does not provide continuous regulation of the flow rate, is suitable when a storage reservoir is present in the system and a variation of the delivery pressure is acceptable; the pressure of the reservoir is controlled by a hysteresis regulator. Generally, the flow rate is regulated by actuators composed of pneumatic devices, which, by acting on a body (the pusher) present in each valve, enable the sealing element to be kept in a predetermined position (open), thus making the compressor idle (zero flow rate); when the said devices are inoperative, the compressor operates at maximum capacity.

The frequency of actuation of the pneumatic devices which operate the pushers of the inlet valves depends on the amplitude of the hysteresis, the volume of the reservoir and the maximum unbalance between the nominal flow rate and the minimum flow rate of the load; however, the said value must be limited to avoid excessive wear on the pneumatic devices.

This type of control of the flow rate of compressors causes a decrease of the global efficiency and of the power factor in the "idle operation" phase; furthermore, the heat generated in the "idle operation" phase is not dissipated, and thus increases the temperature of the sealing elements. Finally, the use of an actuator without position control, its limited response time and rise time, together with the presence of long pipes having limited cross sections and considerable dead space, and the absence of synchronization of the movement with the compressor shaft gives rise to a number of contacts at uncontrolled velocity between the sealing element and the pusher, which reduce the reliability of the valves, causing wear on the pusher and the breakage of the sealing element.

Backflow control is provided by delaying the closing of the inlet valve with respect to the closing point in the case of maximum flow rate. The gas which has entered the cylinder flows back into the inlet duct in a quantity proportional to the portion of the compression stroke during which the inlet valves are kept open.

The use of continuous regulation permits the use of storage reservoirs of limited capacity, since the pressure variations are practically absent. The actuation methods used up to the present time for controlling the position of the sealing element of the valves are of the pneumatic or oil hydraulic type.

Examples of some devices based on continuous backflow regulation are described in the documents U.S. Pat. Nos. 7,331,767 and 5,988,985. These devices use various actuation systems based on fluid which is supplied to a piston. Both systems require a panel for regulating the pressure of the fluid used for the actuation.

SUMMARY OF THE INVENTION

The object of the present invention is therefore to provide equipment for the continuous regulation of the flow rate in reciprocating compressors, by using essentially simple means which limit the wear of the valve components.

The present invention therefore proposes equipment for continuous regulation of the flow rate for a reciprocating compressor, provided with at least one compression chamber in which is slidably inserted a piston means movable with a reciprocating motion, at least one inlet valve for the fluid to be compressed and at least one outlet valve for the compressed fluid being provided in the said chamber, the said outlet valve being connected to a storage reservoir for the compressed fluid, and the said inlet valve being provided with translation means which can act on the obturator of the said valve, the said translation means being movable in a direction perpendicular to the plane of the said obturator, and interacting with actuator means which are movable in the said direction with a reciprocating motion by means of suitable operating means; the said operating means make it possible to control the velocity of displacement of the said actuator means in both directions of their movement; means for detecting the position of the said actuator means, means for detecting the position of the piston in the compression chamber and means for detecting the pressure in the reservoir are provided, the said detection means and the said operating means of the actuator means being connected to a central processing unit.

In a preferred embodiment, the operating means of the said actuator means are electromechanical, and in particular they comprise two solenoids. The actuator means comprise a rod provided in its central portion with a radially projecting magnetizable portion, the said portion interacting with the said solenoids and being placed in equilibrium between the solenoids by the use of suitable resilient loading means. One end of the rod is connected to the said translation means of the sealing element, while its opposite end interacts with means for detecting its position.

BRIEF DESCRIPTION OF THE DRAWINGS

Further advantages and characteristics will be made clearer by the following detailed description of an embodiment of the present invention, provided, by way of example and without restrictive intent, with reference to the attached sheets of drawings, in which.

DETAILED DESCRIPTION OF THE INVENTION

Figure 1:
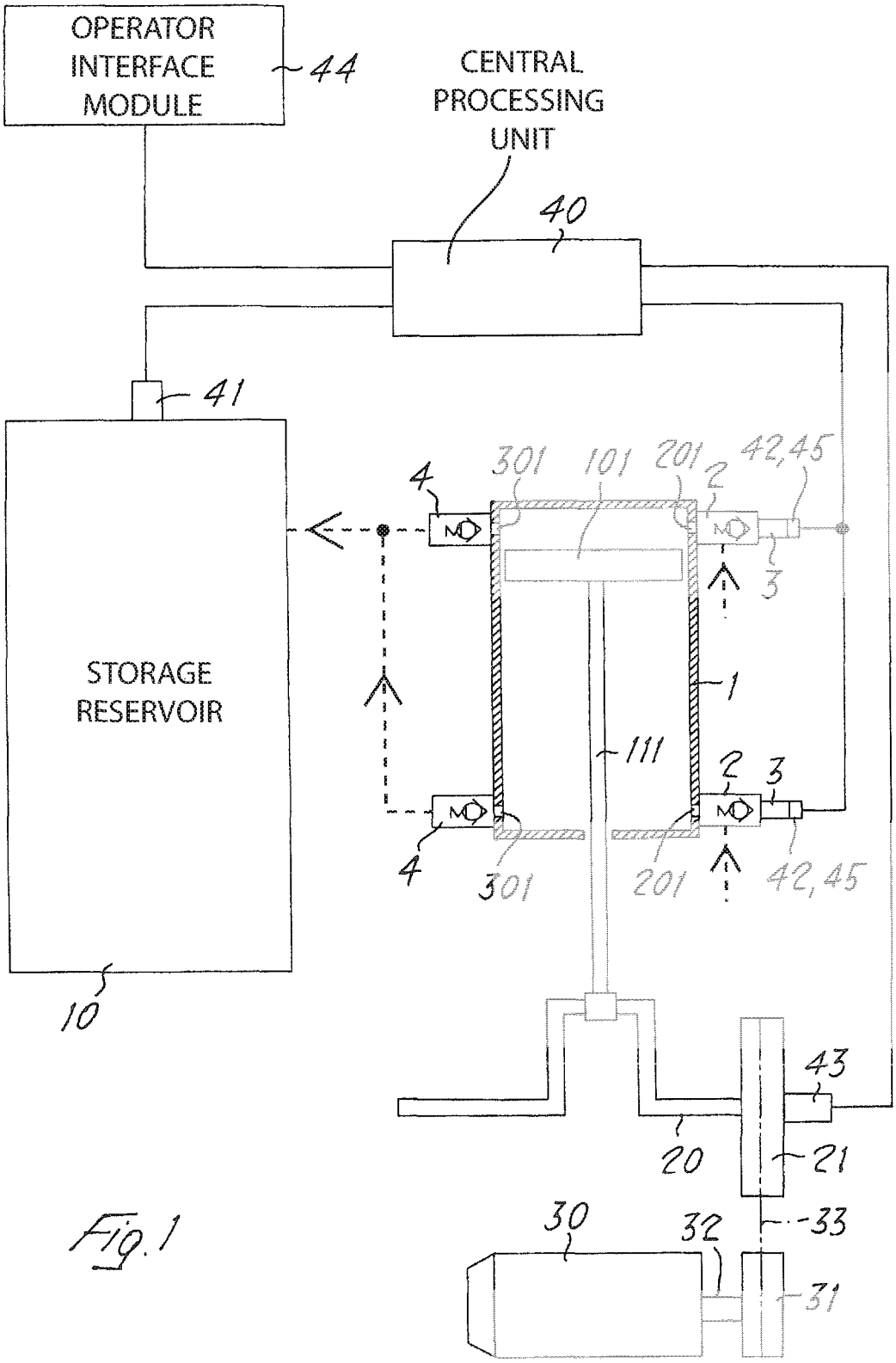
FIG. 1 is a schematic diagram of a compressor provided with the equipment according to the present invention.

FIG. 1 shows schematically a compressor provided with the equipment according to the present invention; the compression chamber is indicated by 1. The said chamber 1 is substantially cylindrical, and into this chamber there is inserted a double-acting piston 101, connected by a rod 111 to the transmission shaft 20, which is connected by means of the pulley 21 and the belt 33 to the pulley 31 keyed to the shaft 32 of the geared motor 30; the shaft 20 is provided with a sensor 43 for detecting its position, connected to the central processing unit 40. The chamber 1 is provided with two inlet ports 201 and two outlet ports 301; each of the inlet ports is provided with an automatic valve 2, provided with actuator means 3, which are described and illustrated more fully below; on the said actuator means 3 there are placed a sensor 42 and control and monitoring means 45, which in turn are connected to the processing unit 40. The outlet ports 301 are also provided with automatic valves 4, through which the compressed fluid is discharged into the storage reservoir 10, the pressure of which is monitored by means of the sensor 41, which is also connected to the central processing unit 40, which also has an operator interface module 44.

Figure 2:
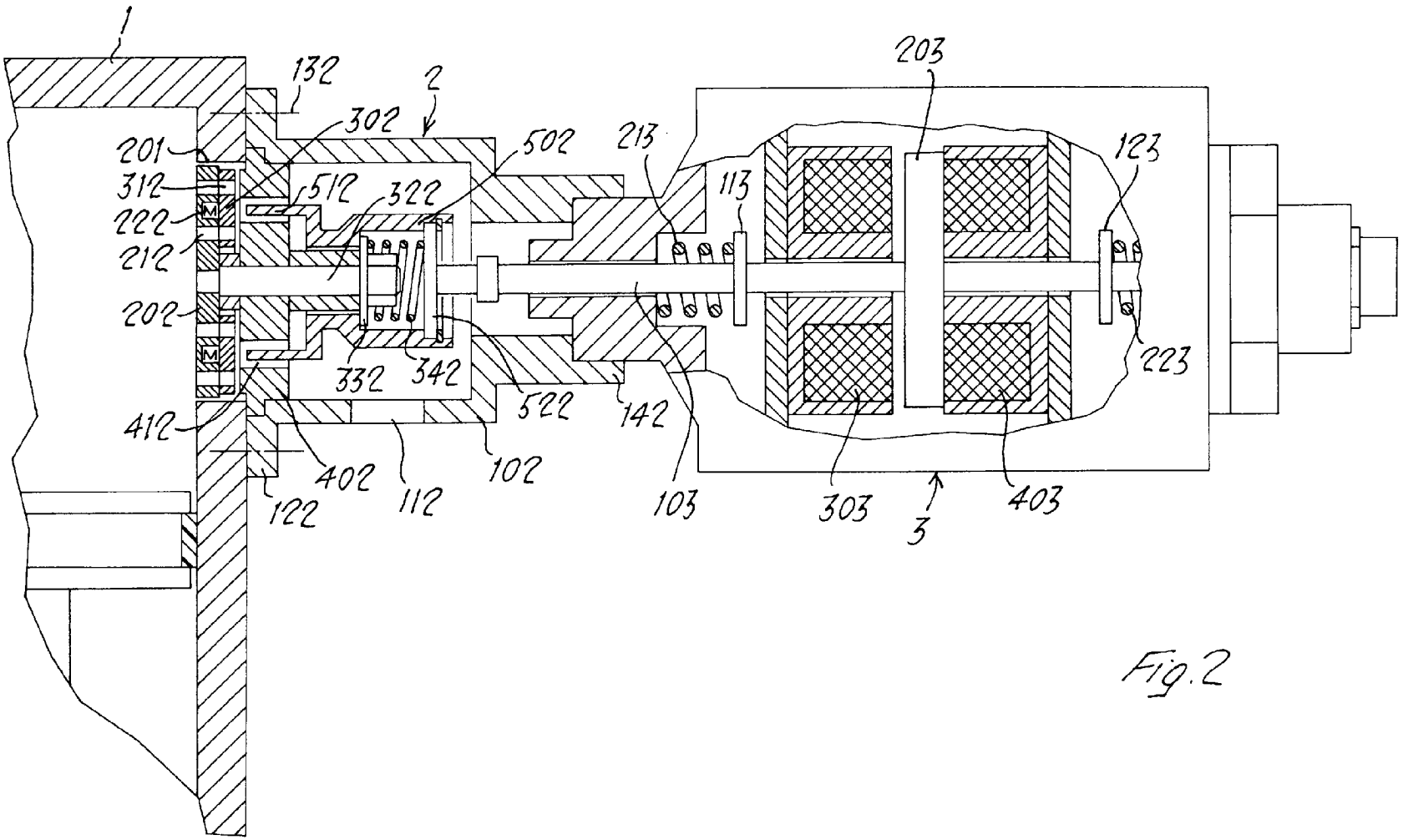
FIG. 2 is a view in lateral elevation with parts in section, representing a detail of an inlet valve of the compressor of FIG. 1.

FIG. 2 shows the inlet valve assembly 2 more fully. The said valve 2 is placed on the port 201 of the chamber 1, and is enclosed in a containing body 102 provided at one end with a radial flange 122 which is connected by the fixing means 132 to the outer wall of the chamber 1, while its opposite end is provided with a bush 142 by which it is connected to the actuator means 3. Inside the port 201 there is placed a counter-seat 202 of the valve 2, comprising the passages 212 for the fluid and the resilient loading means 222 for the sealing element 302, whose passages 312 are coaxial with the passages 212 of the counter-seat 202. Outside the sealing element 302 there is placed the seat 402, whose passages 412 are offset with respect to those of the sealing element and of the counter-seat. The prongs 512 of the pusher 502 pass through the said passages, the pusher being axially slidable with respect to the port 201, and being positioned coaxially with the projecting shaft 322 of the seat 402. Inside the pusher 502 there is a spring 342, one end of which bears on a flange 332 projecting from the shaft 322, while its other end bears on the closing surface 522 of the pusher 502.

The rod 103 extending from the actuator 3 bears axially on the outwardly directed face of the said closing surface 522, this rod passing substantially through the whole length of the said actuator 3, and having, substantially in its central portion, the moving element 203, in the form of a disc of magnetizable material keyed to the said rod 103, the said moving element being positioned between two solenoids 303 and 403, and being movable in a reciprocating way over a given path. Resilient loading means 213 and 223, which interact with the flanges 113 and 123 respectively of the rod 103, are provided in the actuator 3.

Figure 3:
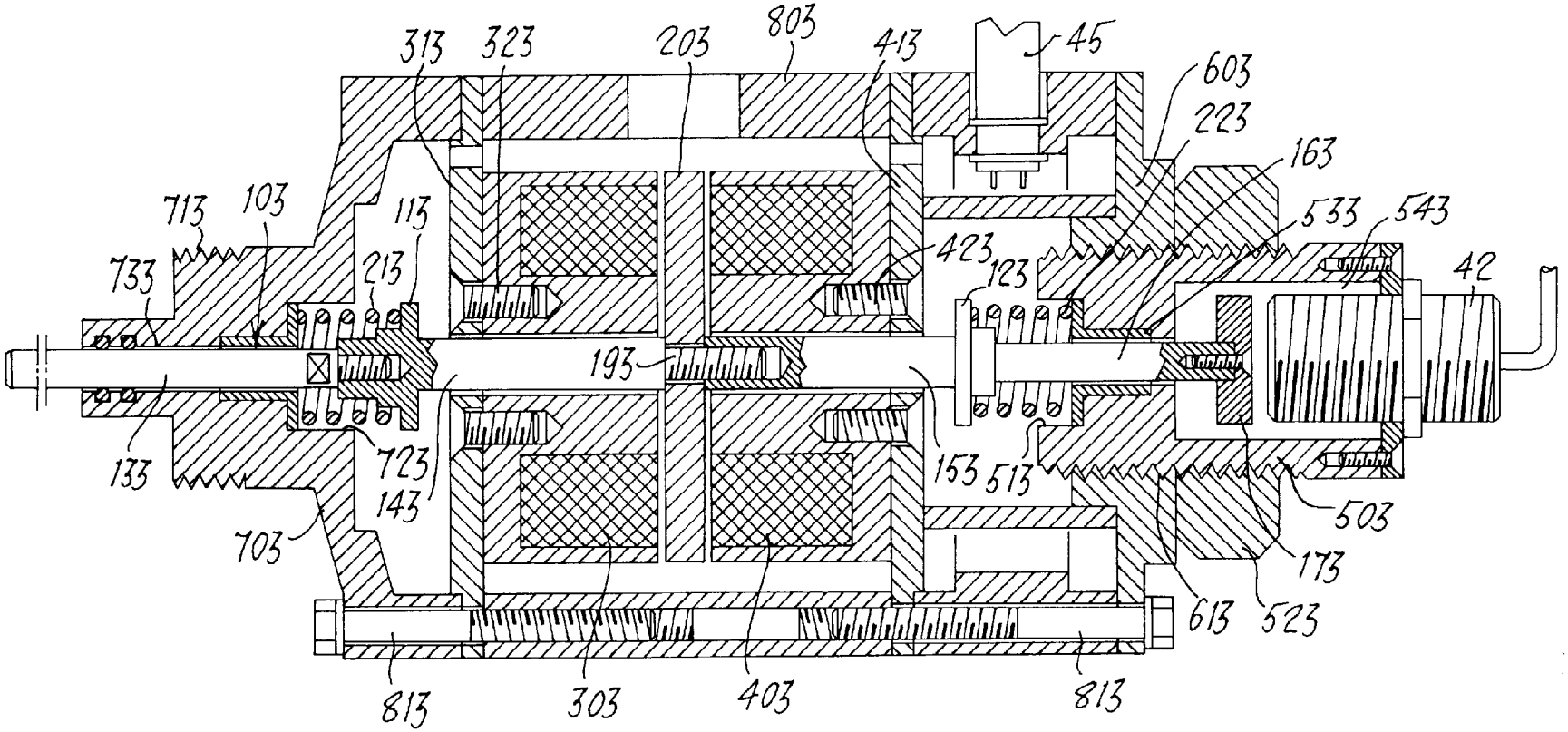
FIG. 3 is an enlarged view in longitudinal section of a detail of FIG. 2.

FIG. 3 shows the actuator 3 of the inlet valve 2 in greater detail; identical numerals refer to identical parts. The rod 103 is composed of a plurality of sections interconnected with each other, comprising the end 133 intended to interact with the pusher 502 (see FIG. 2), the portion 143 which carries the flange 113 interacting with the spring 213, and which is coupled by means of the screw 193 to the portion 153 to support the moving element 203 between the two solenoids 303 and 403, which are supported on their respective plates 313 and 413 by the fixing means 323 and 423 respectively. The actuator 3 comprises a cylindrical body 803 in which the control and monitoring probe 45 of the solenoids 303, 403 is inserted radially, this probe being connected to the central processing unit, indicated by 40 in FIG. 1. At the end of the cylindrical body 803 facing the inlet valve 2 there is connected, by the fixing means 813, the head 703, which is provided axially with a cavity 723 for housing the spring 213, and with a threaded shank 713 intended to interact with the bush 142 of the body 102 of the valve 2. The shank 713 and the cavity 723 are coaxial, and the channel 733, into which the end 133 of the rod 103 is inserted, passes through both of them.

The opposite end of the cylindrical body 803 of the actuator 3 comprises a cap 603 provided with a threaded axial hole 613, into which is inserted the block 503, which is also threaded; the said block has a cavity 513 facing towards the inside of the actuator, the spring 223 which interacts with the flange 123 of the rod 103 pressing into this cavity, and a cavity 543 facing the outside of the actuator 3, this cavity housing the plate 173 connected to the end 163 of the rod 103, which interacts with the sensor 42. The two cavities communicate by means of the channel 533, through which the end 163 of the rod 103 passes. The position of the block 503 can be fixed by means of the locking bolt 523.

Figure 4:
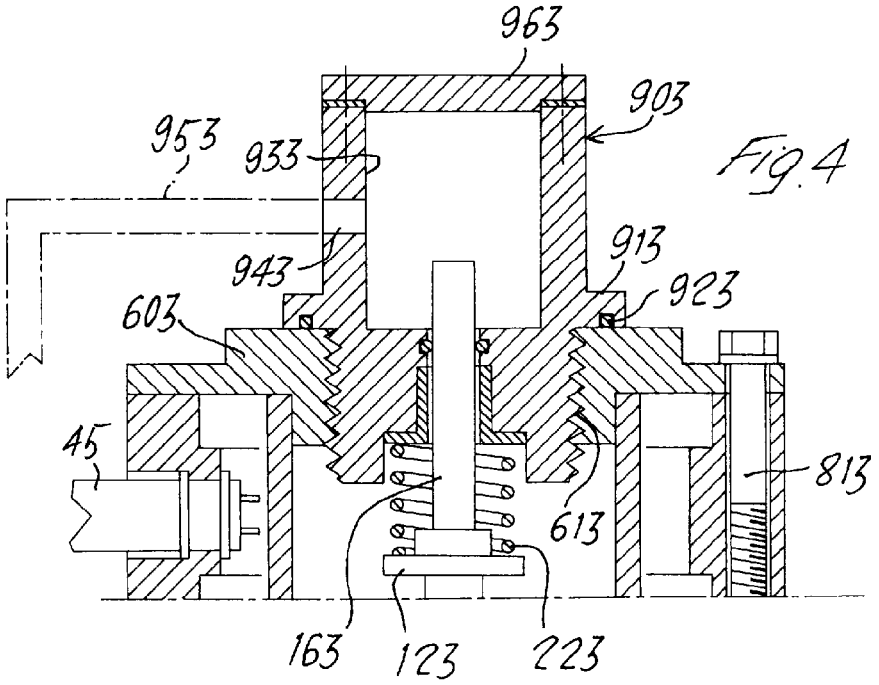
FIG. 4 shows a detail in section relating to a variant embodiment of the present invention.

FIG. 4 shows a variant embodiment of the present invention; identical numerals refer to identical parts. In the figure, the block 503 is replaced by the block 903, which is provided with a flange 913, provided with sealing means 923, which bears on the cap 603 into which the said block 903 is screwed. The chamber 933 inside the block 903, into which the end 163 of the rod 103 penetrates, communicates by means of the hole 943 and the pipe 953 with the environment upstream of the valve described above; the chamber 933 is closed by the cap 963.

The operation of the equipment according to the present invention will be made clear by the following text, with particular reference to the figures described above and to the graphs in FIGS. 5 to 7. As stated in the introduction, one of the most important problems in the regulation of the flow rate of reciprocating compressors is that of the appropriate control of the means which act on the sealing element of the inlet valve in order to modify its opening and closing times. The response times of these means with respect to a given command and the extent of their impact on the sealing element are crucial factors in achieving the optimal operation of the inlet valve and consequently the optimal regulation of the compressor flow rate.

Figure 5:
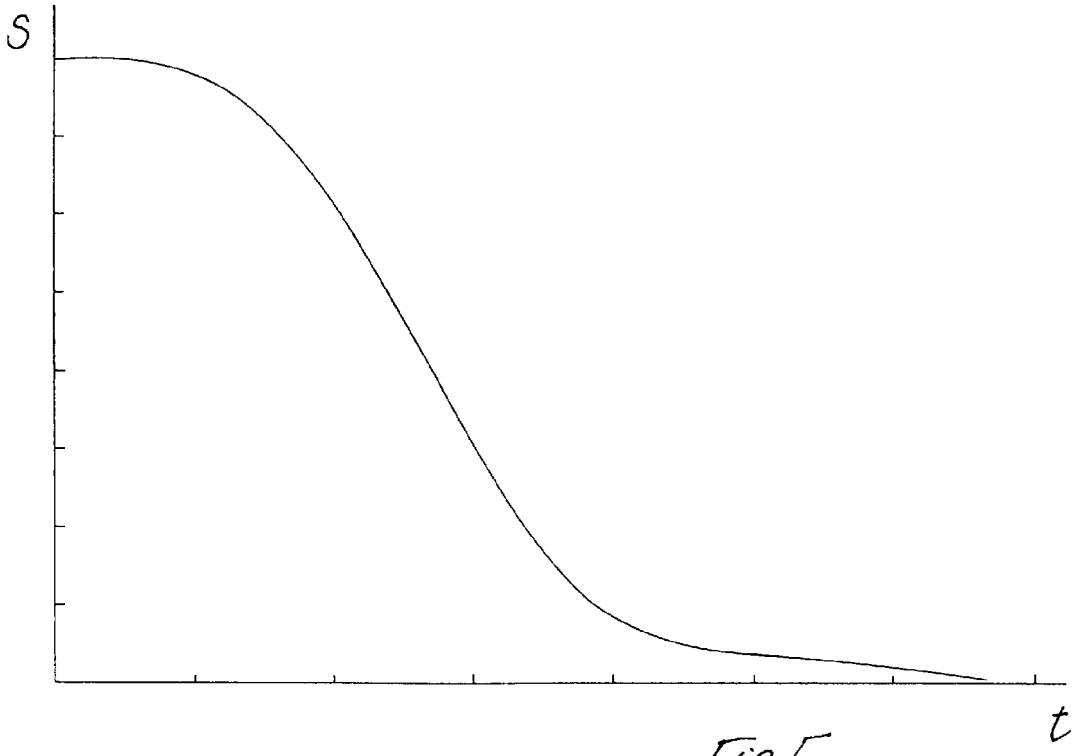
FIG. 5 is a graph of the variation of the position of the actuator of the inlet valve during a transition from a closed valve to an open valve state as a function of time.

In the equipment according to the present invention, the solution is implemented by providing the sealing element translation means, in this case the pusher 502 of the valve 2 with its prongs 512 which, in a first position acts on the surface of the sealing element 302, with actuator means operated in such a way as to enable their velocity of displacement to be controlled in both directions of their movement, with markedly reduced reaction times. In a second position, the prongs 512 engage the sealing element, keeping it off of the valve seat and thus keeping the valve open. In this case, the operation is provided by means of the two solenoids 303 and 403 which cause the displacement of the moving element 203 which is fixed to the rod 103. The processing unit 40 detects the position of the piston 101 by means of the sensor 43 located on the shaft 20, and then coordinates the movement of the rod 103. As shown in the graph of FIG. 5, the rod 103 of the actuator, in the transition from the closed to the open state of the valve, with the moving element initially attached to the solenoid 403, as shown in FIG. 2, moves fairly rapidly towards the sealing element 302, which is already opening; its action subsequently becomes markedly slower.

The moving part of the pneumatic actuator and consequently the pusher of the inlet valve have a very slow movement, equal to several compression cycles, and therefore a series of impacts occurs between the pusher and the valve obturator. The high transition velocity of the electromechanical actuator makes it possible to complete the whole of the compressor's loading cycle within a limited portion of the operating cycle, thus controlling the velocity of the impact of the sealing element against the valve seat, and avoiding the series of impacts between the pusher and the sealing element.

Thus the regulation of the flow rate of the compressor is achieved while the stress factors causing the deterioration of the sealing element 302 are kept to a minimum; this is because the contact between its surface and the prongs 512 of the pusher 502 always occurs at very low velocities, with a reasonably low degree of impact. Furthermore, the central processing unit always has a precise confirmation of the position of the rod 103, owing to the sensor 42, and the signal to the solenoids 303 and 403 can therefore be suitably regulated, by means of the control and monitoring probe 45. It should be noted that the position of the rod 103 of the actuator 3 can be regulated by means of the block 503, and similar the distance between the solenoids 303, 403 can also be selected conveniently according to the travel required to actuate the pusher 502.

FIG. 4 shows a variant which provides an alternative to the system regulating the position of the rod 103 described above. A chamber 933 maintains an equilibrium between the forces acting on the moving part, when a pressurized fluid is present at the end of the rod 133; the said chamber 933, which is connected by means of a pipe 953 to the environment upstream of the corresponding valve, makes it possible to cancel out the effect of a variation of pressure in the environment upstream of the valve in which is immersed the terminal part of the rod 133 in contact with the pusher. Because there is a difference between the inlet diameter and the outlet diameter, providing a guaranteed cross section equal to that of the rod 133, the resultant of the forces acting on the rod is zero.

Figure 6:
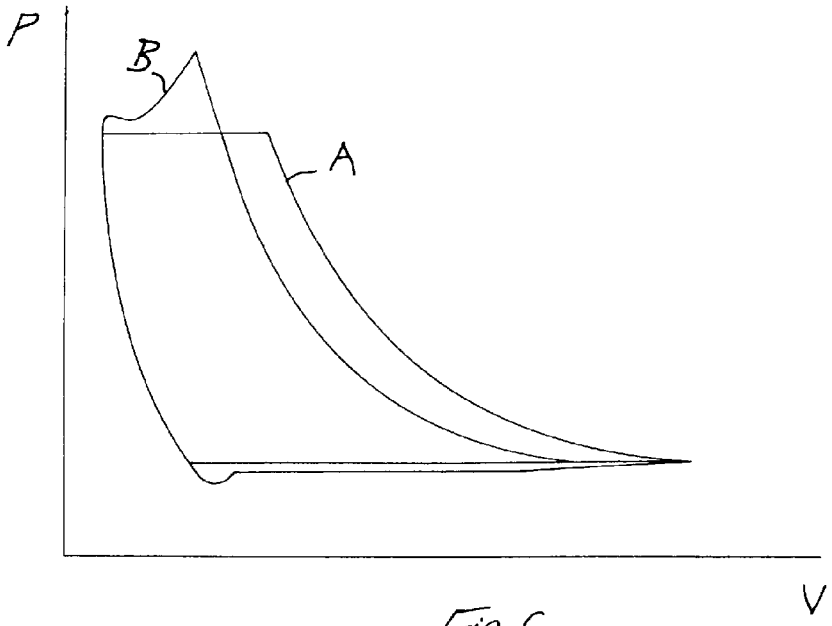
FIG. 6 is a pressure-volume diagram relating to the compressor provided with the equipment according to the invention.

FIG. 6 shows the effect of the continuous regulation on the PV diagram of the reciprocating compressor; it should be noted that keeping the inlet valve open at the start of compression reduces the flow rate of the machine (Diagram B) by comparison with the maximum flow rate operation (Diagram A).

Figure 7:
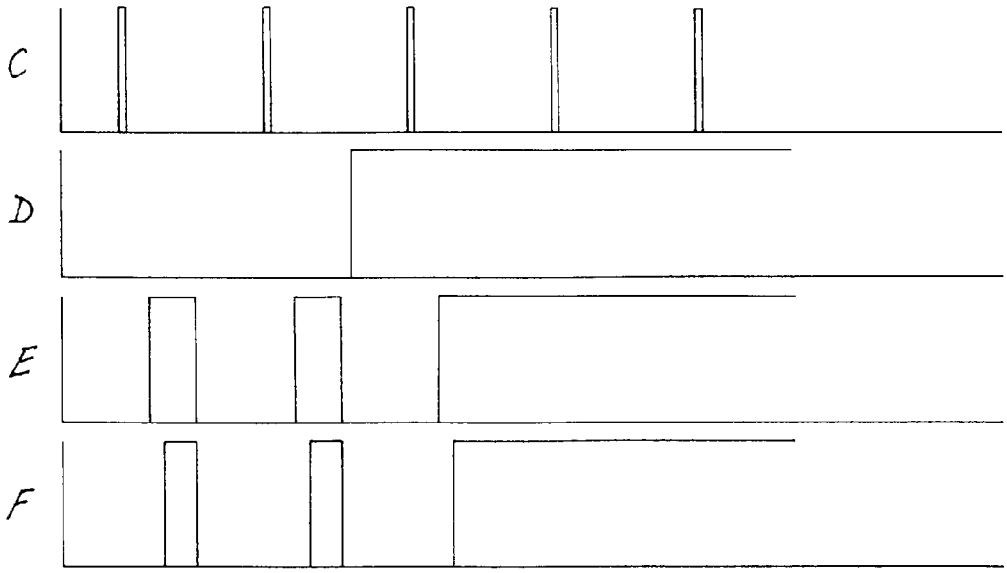
FIG. 7 is a set of diagrams showing the variations of the signals and sealing positions of the valve and of the actuator.

With reference to the operation of a reciprocating compressor with step regulation of the "idle/load" type, FIG. 7 shows the variation of the signal (Diagram C) obtained from the sensor 43, the signal for switching the machine to idle (Diagram D) and the signal indicating the positions of the sealing element of the valve (Diagram E) and of the moving element (Diagram F) of the actuator 3.

The moving part of the actuator starts its positioning not on the rising edge of the signal (D), but on the edge of the signal from the sensor 43 (C), in order to avoid a high contact force caused by the high internal pressure of the cylinder: in this situation, the inlet valve is already open, because the contact pressure due to the impact between the pusher and the sealing element is absent.

Similarly, during the return of the actuator rod, a phenomenon found in pneumatic actuators is avoided, owing to the limited return velocity: the moving part of the pneumatic actuator and consequently the pusher of the inlet valve have a very slow movement, equal to several compression cycles, and therefore a series of impacts occurs between the pusher and the sealing element of the valve. The high transition velocity of the electromechanical actuator makes it possible to complete the whole of the compressor's loading cycle within a limited portion of the operating cycle, thus controlling the speed of the impact of the sealing element against the valve seat, and avoiding the series of impacts between the pusher and the sealing element.

The invention claimed is:

1. Equipment for continuous regulation of the flow rate of a reciprocating compressor, comprising;

a compressor having a chamber, a piston reciprocally mounted in the chamber, an inlet valve through which fluid is introduced into the chamber, an outlet valve through which compressed fluid is discharged from the chamber, a storage reservoir connected to the said outlet valve to receive fluid discharged from the chamber, a first sensor which senses the position of the piston in the chamber, a second sensor which senses the pressure in the reservoir, the inlet valve having passages through which fluid flows into the chamber, a sealing element mounted to cover and uncover the passages, a counter seat resiliently urged toward the sealing element, causing it to cover the passages, the counter-seat having openings which communicate with the passages when the sealing element does not cover the passages, a pusher engageable with the sealing element to push the sealing element away from a seat so the passages communicate with the openings in the counter-seat so that fluid can flow into the chamber, an actuator rod moveable forward, toward the sealing element and back, away from the sealing element, the actuator rod being moveable in the forward direction to cause the pusher to push the sealing element away from the seat to open the passages, the actuator rod being moveable in the back direction, away from the sealing element, to permit the counter seat to resiliently urge the sealing element to close the passages, an electromechanical device comprising a pair of stationary solenoids surrounding the actuator rod, which actuator rod moves forward and back relative to the solenoids, a central element mounted on the actuator rod and located between the two solenoids so as to be movable between the two solenoids, a third sensor which senses the axial position of the actuator rod, the first, second and third sensors each being connected to a central processor which continuously sends signals of the position of the piston, the pressure in the reservoir and the axial position of the actuator rod, to the central processor, resilient elements on the actuator rod which, at rest place the central element in an equilibrium position between the two solenoids, at which equilibrium position the pusher at the start of compression movement of the piston, is holding the counter-seat away from the passages so that the passages are open, wherein the opening of the passages at equilibrium at the start of the compression stroke of the piston and the presence of continuous signals of the position of the piston, the pressure of the reservoir and the axial position of the actuator rod result in the response times between sending of the signals and movement of the actuator rod being shorter than a suction phase period of the compressor, as a result of which the impact of the pusher on the sealing element is reduced because the pusher starts to touch the sealing element when the suction valve is already open, which is after reaching the equilibrium pressure on the sealing element.

2. Equipment according to claim 1, wherein the pusher comprises a body part engaged by the actuator rod and having prongs at its end which pass through the passages to engage the sealing element.

3. Equipment according to claim 2, including a shaft connected to the counter-seat, and including a spring engaging said shaft at one end and engaging an end of the actuator rod at its other end.

4. Equipment according to claim 1, wherein the sealing element is a generally planar element and the pusher acts on the sealing element in a direction perpendicular to the plane of the sealing element.

5. Equipment according to claim 1, in which the loading of the resilient elements acting on the actuator rod is regulated by a regulation device which comprises a moveable body in contact with the resilient elements and located at the end of the actuator rod opposite from the end thereof facing the inlet valve, and a locking device for locking the moveable body.

6. Equipment according to claim 5, in which the regulation device comprises a regulating chamber into which the end of the actuator rod opposite from the inlet valve is inserted, the regulating chamber being in fluid communication with the environment upstream of the inlet valve.

* * * * *